US009481480B2

(12) United States Patent
Harlacher et al.

(10) Patent No.: US 9,481,480 B2
(45) Date of Patent: Nov. 1, 2016

(54) PACKAGING MACHINE WITH SEALING STATION FOR GAS FLUSHING A PACKAGE

(71) Applicant: Multivac Sepp Haggenmüller GmbH & Co. KG, Wolfertschwenden (DE)

(72) Inventors: Dominik Harlacher, Wiggensbach (DE); Andreas Mader, Dietmannsried (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 673 days.

(21) Appl. No.: 13/848,420

(22) Filed: Mar. 21, 2013

(65) Prior Publication Data

US 2013/0247510 A1 Sep. 26, 2013

(30) Foreign Application Priority Data

Mar. 23, 2012 (DE) ..... 10 2012 005 891

(51) Int. Cl.
*B65B 31/04* (2006.01)
*B65B 31/06* (2006.01)
*B65B 31/02* (2006.01)

(52) U.S. Cl.
CPC ..... *B65B 31/04* (2013.01); *B65B 31/028* (2013.01); *B65B 31/043* (2013.01)

(58) Field of Classification Search
CPC ..... B65B 31/02; B65B 31/04; B65B 31/043; B65B 31/06
USPC ..... 53/403, 84, 87, 510, 511, 329.2–329.5; 206/497
See application file for complete search history.

(56) References Cited

U.S. PATENT DOCUMENTS

| | | | | |
|---|---|---|---|---|
| 2,362,799 | A | 11/1944 | Boyd et al. | |
| 4,140,159 | A * | 2/1979 | Domke | B65B 31/041 141/129 |
| 4,312,171 | A * | 1/1982 | Vadas | B65B 31/041 53/403 |
| 5,069,020 | A * | 12/1991 | Sanfilippo | B65B 31/041 141/63 |
| 5,271,207 | A * | 12/1993 | Epstein | B65B 31/043 53/403 |
| 5,417,255 | A * | 5/1995 | Sanfilippo | B65B 31/00 141/1 |
| 5,682,723 | A * | 11/1997 | Nowotarski | B65B 31/041 53/110 |
| 5,735,318 | A * | 4/1998 | Vianello | E06B 3/6775 141/129 |
| 7,690,404 | B2 * | 4/2010 | Marcus | B65B 31/041 141/11 |
| 2011/0072764 | A1 | 3/2011 | Daniek et al. | |

FOREIGN PATENT DOCUMENTS

| | | | |
|---|---|---|---|
| CN | 2468905 | Y | 1/2002 |
| CN | 2612610 | Y | 4/2004 |
| CN | 101357694 | A | 2/2009 |
| CN | 102152868 | A | 8/2011 |
| DE | 2430497 | A1 | 1/1976 |
| DE | 3739432 | A1 | 6/1989 |
| DE | 102006022418 | A1 | 11/2007 |

(Continued)

*Primary Examiner* — Andrew M Tecco
*Assistant Examiner* — Praachi M Pathak
(74) *Attorney, Agent, or Firm* — Husch Blackwell LLP

(57) ABSTRACT

The invention relates to a packaging machine including a sealing station which is used for sealing a package comprising a trough and a cover film, and which has at least two sides, the sealing station including a sealing tool provided with at least one evacuation aperture for discharging the atmosphere and at least one gas flushing aperture for supplying a gas volume flow.

10 Claims, 3 Drawing Sheets

(56) References Cited

FOREIGN PATENT DOCUMENTS

| | | | |
|---|---|---|---|
| DE | 60221410 | T2 | 4/2008 |
| DE | 102007047058 | A1 | 4/2008 |
| EP | 0328638 | A1 | 8/1989 |
| EP | 1842776 | A2 | 10/2007 |
| WO | 9933703 | A1 | 7/1999 |
| WO | 2011018391 | A1 | 2/2011 |
| WO | 2011124548 | A1 | 10/2011 |

* cited by examiner

PACKAGING MACHINE WITH SEALING STATION FOR GAS FLUSHING A PACKAGE

CROSS-REFERENCE TO RELATED APPLICATIONS

This Application claims priority to German Application Number 102012005891.8 filed Mar. 23, 2012, to Dominik Harlacher and Andreas Mader entitled "Packaging machine with sealing station for gas flushing a package," currently pending, the entire disclosure of which is incorporated herein by reference.

FIELD OF THE INVENTION

The invention relates to a packaging machine including a sealing station.

BACKGROUND OF THE INVENTION

Thermoform packaging machines and tray sealers configured for providing, by using vacuum and optionally also by using gas flushing, packages with very low residual oxygen values so as to guarantee a long durability, for example, in the case of foodstuffs, are known from the applicant's enterprise. In order to accomplish low residual oxygen values of less than 0.05%, it is normally necessary to evacuate the volume in the interior of the package to less than 10 mbar. For achieving this high vacuum value, a high performance of the vacuum pump and a long evacuation time are necessary. This has a negative influence on the performance of the packaging machine, since the number of producible packages per unit time decreases.

For increasing the performance of the packaging machine, a gas flushing system can additionally be used. In the case of such systems, the volume in the interior of the sealing station and of the package is evacuated to a value of, for example, 500 mbar and part of the oxygen is removed from the package in this way. The supply of gas causes a further displacement of the residual oxygen molecules from the interior of the package and leads to a further reduction of the residual oxygen value. The gas is supplied on one side of the package through gas flushing apertures in the sealing tool and discharged on the opposite side through evacuation apertures. A part of the gas volume flow flows in the upper area of the package from the gas flushing aperture side to the evacuation aperture side. Another part of the gas volume flow flows into the lower part of the package and from there upwards again. This results in a point of intersection of this gas volume flow and in flow losses caused by turbulences. This has a negative influence on the displacement of the oxygen molecules from the package. This combination is nevertheless advantageous, on the one hand, insofar as the processing time will be shorter than in cases where evacuation alone is used and, on the other hand, insofar as it is possible to provide packages having only a low vacuum and, consequently, a lower load on the package but nevertheless low residual oxygen values. If the product in question is meat, the package may, alternatively, also be flushed with a gas mixture of oxygen and carbon dioxide so as to establish an oxygen content of 30 to 50%. The high oxygen content ensures an enduring red color of the meat and the carbon dioxide content provides durability.

SUMMARY OF THE INVENTION

It is the object of the present invention to provide a packaging machine which increases the packaging machine performance and which simultaneously improves the gas flushing efficiency and/or the evacuation efficiency so as to reduce the manufacturing costs for packages having very low residual oxygen values or very high oxygen values of more than 30%.

The packaging machine according to the present invention includes a sealing station for sealing a package, which, in turn, comprises a trough for accommodating a foodstuff, and a cover film, the sealing station comprising a sealing tool provided with at least one evacuation aperture for discharging the atmosphere and at least one gas flushing aperture for supplying a gas volume flow. The sealing tool is characterized in that the evacuation aperture and the gas flushing aperture may be arranged in common on one side of the sealing tool. To those skilled in the art it was most surprising to see that this arrangement of the gas flushing aperture and the evacuation aperture leads to improved residual oxygen values and to a reduction of the processing time and, consequently, to an increase in the performance of the packaging machine This is due to the fact that the gas volume flow exhibits a generally U-shaped flow profile in the upper as well as in the lower part of the package and that neither a point of intersection nor turbulences occur. The flow profile ensures an unhindered and fast displacement of the oxygen molecules from the package via the evacuation apertures.

According to one embodiment, a plurality of evacuation apertures and a plurality of gas flushing apertures are provided, the maximum difference between the overall cross-section of the evacuation apertures and the overall cross-section of the gas flushing apertures being 20%, and preferably 5%. This will provide a large gas volume flow whereby the gas flushing efficiency will be increased still further, said increase in efficiency leading to a further reduction of the processing time thus maximizing the performance of the packaging machine.

At least three evacuation apertures and at least three gas flushing apertures may be provided so that the gas volume flow can flow in not only at certain points but over a wider area. This leads to an improvement of the distribution of the gas volume flow within the package and to an increase in efficiency. A smaller amount of gas will be necessary and the gas flushing period for displacing the oxygen molecules can be reduced still further.

The evacuation aperture(s) and the gas flushing aperture (s) are preferably arranged such that a U-shaped flow profile of the gas volume flow can be generated within the package from the gas flushing aperture to the evacuation aperture, said flow profile providing an improved flow behavior and an improved efficiency.

According to one embodiment, the evacuation aperture(s) and the gas flushing aperture(s) are arranged such that a U-shaped flow profile of the gas volume flow can also be produced in the upper area and in the lower area of the package from the gas flushing aperture to the evacuation aperture, so as to minimize the residual oxygen content still further.

The evacuation aperture and the gas flushing aperture can be arranged at respective opposed ends of the common side so as to improve the flow behavior of the gas volume flow.

The gas flushing aperture can be arranged in the sealing tool above an edge of the package so as to guarantee a direct, unhindered flow into the package.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are provided with identical reference numerals throughout the figures.

DETAILED DESCRIPTION OF THE INVENTION

Figure 1:
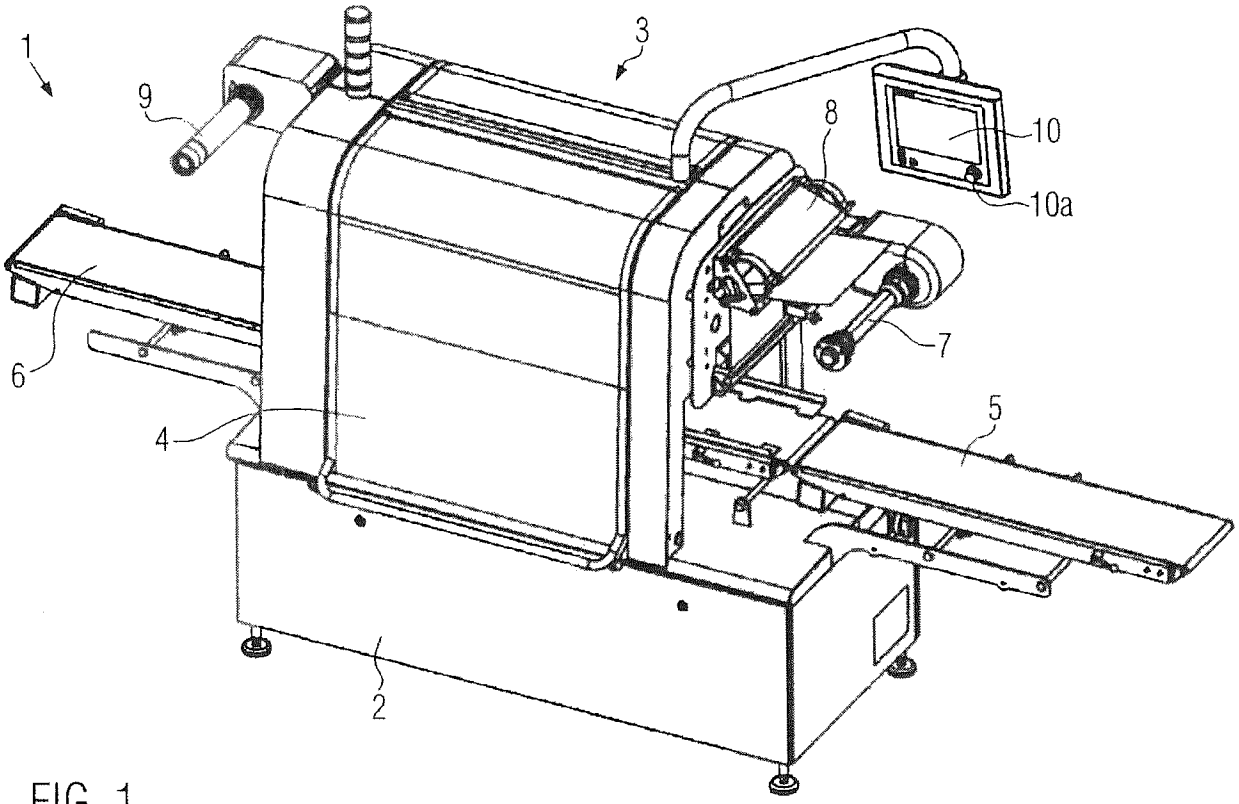
FIG. 1 is a perspective view of a packaging machine in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a perspective view of a first embodiment of packaging machine 1 according to the present invention. This embodiment is a tray sealer. The packaging machine 1 is provided with a machine frame 2 having arranged thereon a sealing station 3 for closing and, if desired, evacuating, flushing with gas and/or sealing tray-shaped containers supplied thereto as well as for cutting a cover film used for closing. The sealing station 3 is located below an openable hood 4.

The packaging machine 1 is additionally provided with a feed belt 5 for feeding the packages, a discharge belt 6 for transporting the closed packages away, a film supply reel 7 for receiving thereon and supplying a cover film roll, a film tensioner 8 for tensioning the cover film, and a residual film winder 9 for winding up the film residues that remain after sealing. A display 10 enables an operator of the packaging machine 1 to check and control the operation of the packaging machine 1. For this purpose, control elements 10*a*, for instance control panels or switches, may be provided on the display 10 so that the operation of the packaging machine 1 can be influenced. Evacuation settings, such as the vacuum value or evacuation times, as well as gas flushing settings, such as the amount of gas and target values for a residual oxygen value in recipes for different packages and products, can be stored and managed in the control unit.

Figure 2A:
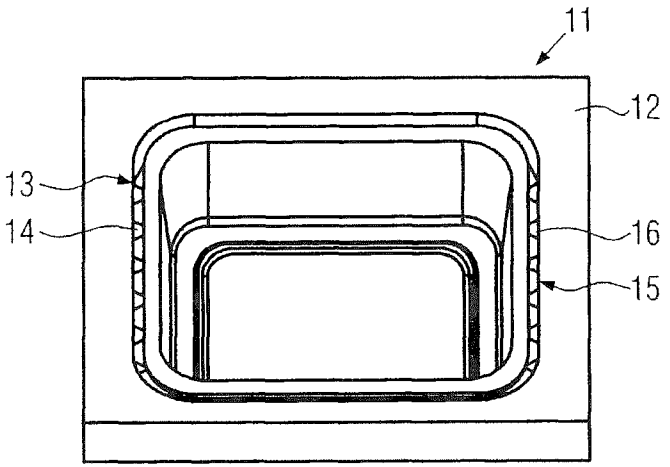
FIG. 2a Prior Art
FIG. 2*a* is a schematic view of a sealing tool according to the prior art.

FIG. 2*a* shows a sealing tool 11 in the form of a sealing tool bottom 12 provided for a package 20. The sealing tool bottom 12 includes on the first or left side 13 five gas flushing apertures 14 and on the opposite or second side 15 four evacuation apertures 16. This kind of arrangement of opposed gas flushing and evacuation apertures is known from the prior art.

Figure 2B:
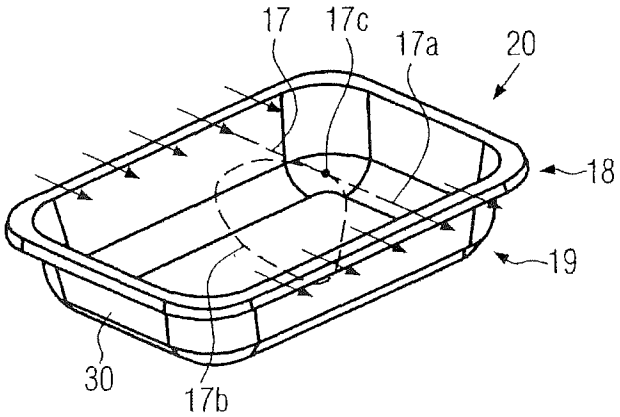
FIG. 2b Prior Art
FIG. 2*b* is a schematic view of a package with a flow profile according to the prior art.

A resultant flow profile of the gas volume flow 17 is schematically shown in FIG. 2*b*. A first part 17*a* of the gas volume flow 17 flows in the upper area 18 of the package 20, which includes a trough 30 for accommodating a foodstuff, along a largely linear path from a gas flushing aperture 14 to an evacuation aperture 16. A second part 17*b* of the gas volume flow flows downwards into a lower area 19 of the package 20. This results in a reversal of the direction of flow and a point of intersection 17*c* as soon as the flow flows back from below into the upper area 18 and to the evacuation aperture 16. This has the effect that turbulences and, consequently, flow losses occur.

Figure 3A:
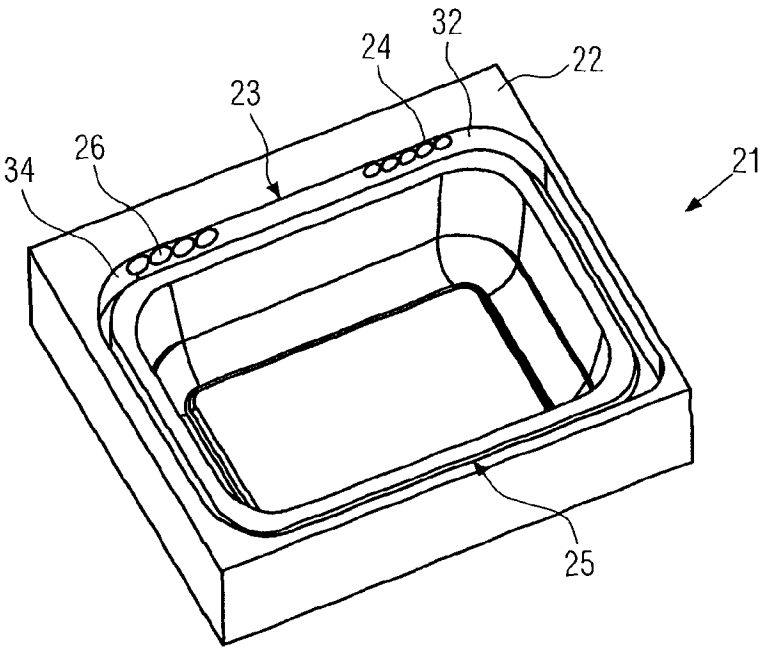
FIG. 3*a* is a schematic view of a sealing tool in accordance with one embodiment of the present invention.

FIG. 3*a* shows a sealing tool 21 according to one embodiment of the present invention in the form of a sealing tool bottom 22. The side 25 located opposite the gas flushing apertures 24 is not provided with any gas flushing or evacuation apertures. The gas flushing apertures 24 as well as the evacuation apertures 26 are provided in common on only one side 23. In one embodiment, the four gas flushing apertures 24 shown in FIG. 3*a* are arranged at the right end 32 of side 23 and the four evacuation apertures 26 are arranged on the left end 34 of side 23 so as to establish a maximum distance which is particularly advantageous for a U-shaped course of the gas volume flow 27. The gas flushing apertures 24 can be arranged above the upper tray edge 31 of the package 20.

Figure 3B:
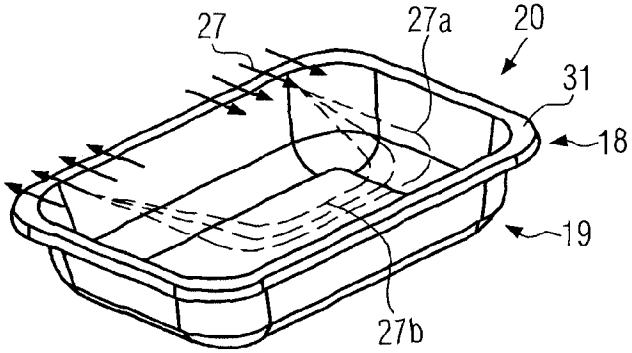
FIG. 3*b* is a schematic view of a package with a flow profile of the sealing tool in accordance with one embodiment of the present invention.

FIG. 3*b* shows the gas volume flow 27 comprising a component 27*a* in the upper area 18 of the package 20 and a component 27*b* in the lower area 19 of the package 20. This U-shaped flow profile shows that there are neither any points of intersection nor any colliding gas volume flows.

The number of gas flushing apertures 24 and evacuation apertures 26 need not be identical, but it proved to be advantageous when the overall cross-section of the gas flushing apertures 24 corresponds approximately to the overall cross-section of the evacuation apertures 26. The orientation of the evacuation apertures 26 and of the gas flushing apertures 24 is not limited to the horizontal orientation, which is shown in FIG. 3*a*.

In the event that no evacuation should be carried out prior to gas flushing, the evacuation aperture 26 will be used as an outlet aperture for the gas volume flow and the displaced atmosphere, respectively.

In the case of packages 20 that are round or oval in shape and sealing tools 21 that are round or oval in shape and adapted to accommodate such packages 20, a first side 23 represents one half and a second side 25 the opposite half of the circle or oval in the context of the present invention.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A packaging machine including a sealing station for sealing a package having a trough and a cover film, the sealing station comprising:

a sealing tool including:

a cavity defined at least in part by at least two side surfaces and a bottom surface, the cavity having an enclosed perimeter defined by the at least two side surfaces, the enclosed perimeter corresponding to an outer shape of the package and wherein the cavity is sized to receive the package;

wherein a first side surface of the at least two side surfaces includes a first end and a second end;

at least one evacuation aperture for discharging the atmosphere from the package when the package is received in said cavity, each of said at least one evacuation apertures are disposed on said first side surface proximate said first end of said first side surface, and at least one gas flushing aperture for supplying a gas volume flow into said package when the package is received in said cavity, wherein each of said at least one gas flushing apertures are disposed on said first side surface proximate said second end of said first side surface.

2. The packaging machine according to claim 1, wherein a plurality of evacuation apertures and a plurality of gas flushing apertures are provided, the maximum difference between the overall cross-section area of the evacuation apertures and the overall cross-section area of the gas flushing apertures being 20%.

3. The packaging machine according to claim 1, wherein at least three evacuation apertures and at least three gas flushing apertures are provided.

4. The packaging machine according to claim 1, wherein the at least one evacuation aperture and the at least one gas flushing aperture are arranged on said first side surface such that a U-shaped flow profile of the gas volume flow is generated within the package when the package is received in the cavity, said U-shaped flow profile begins at the at least one-gas flushing aperture and ends at the at least one evacuation aperture.

5. The packaging machine according to claim 4, wherein said U-shaped flow profile is obtained in an upper area and in a lower area of the package when the package is received in the cavity.

6. The packaging machine according to claim 4, wherein a first said U-shaped flow profile is obtained in an upper area of the package and a second said U-shaped flow profile is obtained in a lower area of the package when the package is received in the cavity.

7. The packaging machine according to claim 1, wherein the at least one gas flushing aperture is disposed on the first side surface of the sealing tool such that the at least one gas flushing aperture is disposed above an upper edge of the trough of the package when the package is received in the cavity of the sealing tool.

8. A sealing tool for a sealing station included in a packaging machine for sealing a package having a trough and a cover film, said sealing tool comprising:

a cavity defined by at least a first side surface, a second side surface, a third side surface, a fourth side surface and a bottom surface, wherein said first side surface, said second side surface, said third side surface, said fourth side surface at least partially define an enclosed perimeter of said cavity, wherein said enclosed perimeter of said cavity corresponds to an outer shape of the package;

said cavity sized to receive said package;

said first side surface having a first end and a second end, said first end being proximate an intersection between said first side surface and said second side surface, and said second end being proximate an intersection between said first side surface and said third side surface;

at least one evacuation aperture disposed on said first side surface for discharging the atmosphere from the package, each of said at least one evacuation apertures being disposed proximate said first end of said first side surface, and at least one gas flushing aperture disposed on said first side surface for supplying a gas volume flow into the package, each of said at least one evacuation apertures being disposed proximate said second end of said first side surface.

9. The sealing tool according to claim 8 wherein the enclosed perimeter of the cavity is rectangular in shape, and wherein said first side surface opposes said fourth side surface and said second side surface opposes said third side surface.

10. The sealing tool according to claim 8, wherein the at least one gas flushing aperture is disposed on the first side surface of the sealing tool such that the at least one gas flushing aperture is disposed above an upper edge of the trough of the package when the package is received in the cavity of the sealing tool.

* * * * *